United States Patent [19]

Lovgren

[11] 3,968,605

[45] July 13, 1976

[54] ADJUSTABLE COLUMN FOR BUILDINGS

[75] Inventor: Richard A. Lovgren, Allison Park, Pa.

[73] Assignee: Aluminum Company of America, Pittsburgh, Pa.

[22] Filed: Dec. 27, 1974

[21] Appl. No.: 536,876

[52] U.S. Cl. ..... 52/126; 52/127; 52/729; 248/354 S

[51] Int. Cl.[2] ..... E02D 35/00

[58] Field of Search ..... 52/122, 126, 221, 244, 52/301, 729, 758 N, 758 F, 127; 403/21, 22; 151/44, 54; 248/188.4, 354 S

[56] References Cited

UNITED STATES PATENTS

| | | | |
|---|---|---|---|
| 2,086,009 | 7/1943 | Walker | 52/301 |
| 2,963,131 | 12/1960 | Brockway | 52/122 |
| 3,222,030 | 12/1965 | Thorpe | 52/122 |
| 3,253,373 | 5/1966 | Diack | 52/301 |
| 3,546,834 | 12/1970 | Murawski | 52/122 |
| 3,655,161 | 4/1972 | Schueler | 248/354 S |
| 3,705,471 | 12/1972 | Allen | 52/729 |
| 3,837,127 | 9/1974 | McMichael | 52/126 |

*Primary Examiner*—Frank L. Abbott
*Assistant Examiner*—William Randolph
*Attorney, Agent, or Firm*—Robert E. Isner

[57] ABSTRACT

An adjustable load-bearing column assembly for supporting beams and the like including for on-site assemblage in superimposed operative engaging relation, an elongated H-shaped column of selectable length having a pair of parallel side wall segments joined together by a transverse web constituting a C-shaped tubular core and a pair of web segments extending from the core and joined to the midpoints of the side wall segments, a bearing plate having an opening concentric with and overlying the tubular core at the upper end of the column, a bolt having a selectively contoured head and a threaded shaft carrying a nut in adjustable threaded engagement therewith, the undersurface of the nut being in supportive relation with the bearing plate upper surface and the portion of the threaded shaft beneath the nut freely extending through the bearing plate opening and into the tubular core of the column, and a beam-embracively supporting bracket having an opening shaped and sized to non-rotatably receive and contain the bolt head to prevent rotation of the bolt when the nut is turned to effect vertical displacement thereof.

4 Claims, 2 Drawing Figures

ADJUSTABLE COLUMN FOR BUILDINGS

The present invention relates to vertically adjustable support structures for load-bearing beams and the like and more particularly to an improved construction for a site dimensionable and assemblable vertically adjustable load-bearing column assembly for the support of spanning beams such as may be conventionally found in various types of buildings and structures.

"Lolly" columns or "jack posts" in the form of simple steel tubes having a rotatably displaceable bolt threaded into one end thereof and a bearing plate at the other end thereof are widely employed at the present time as vertically adjustable support structures in the areas of interest. Although the art is replete with suggested improvements therefor, such conventional structures are still most widely employed despite their relatively fixed dimensions, their inherent hazard of slippage and limited accommodation of external stresses.

The invention may be briefly described as an improved construction for a vertically adjustable load-bearing column assembly which includes, in its broad aspects, a selectively contoured and site dimensionable column member and a site assemblable, beam engaging and vertically adjustable assembly adapted for disposition intermediate the upper end of said site dimensionable column and the undersurface of the spanning beam of other weight bearing structure that is to be supported. In its more narrow aspects, the subject invention includes a pair of selectively shaped metal plate members engageable with the end of the metal column and the weight bearing structure and accommodating an intermediately disposed adjustable nut and bolt assembly that is readily site assemblable and minimizes slippage hazards attendant its installation and use.

Among the advantages of the subject construction is the provision of selectively shaped and elongated metal column members, most suitably of extruded aluminum alloy, which can be readily cut to desired length on site and then assembled to satisfy the instant job requirement. Still other advantages are the provision of an adjustable load-bearing column assembly that is characterized by high strength, light weight, and ready on site dimensioning, assembly, installation and adjustment.

Other objects and advantages of the present invention will become apparent from the following portions of this specification and from the accompanying drawings which illustrate a presently preferred embodiment thereof incorporating the teachings of the invention.

Referring to the drawings.

Figure 1:
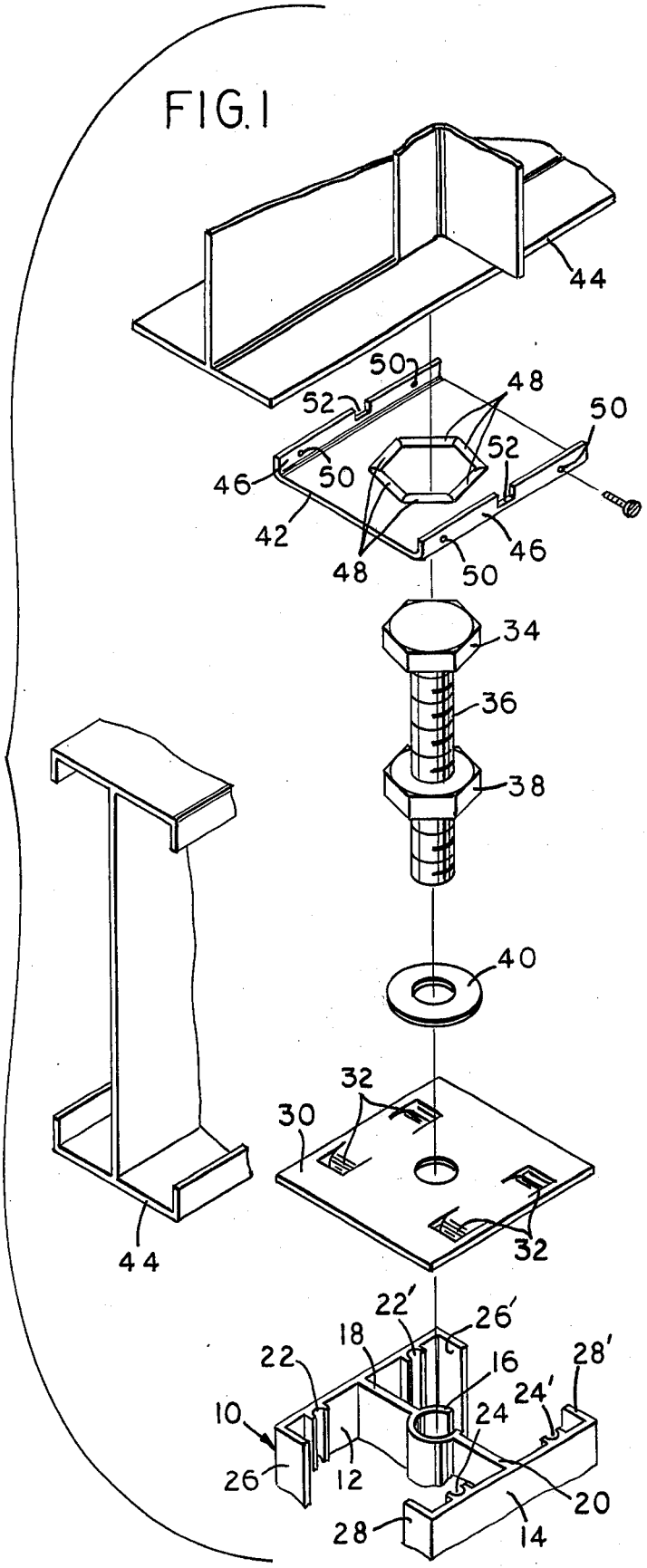
FIG. 1 is an exploded oblique view of the load-bearing column and adjustment assembly.

Referring to the drawings and initially to FIG. 1, there is shown an elongated metal column 10 of generally H-shaped cross-sectional configuration and preferably integrally formed of extruded aluminum alloy. The elongated column 10 is selectively contoured to provide two spaced parallel side wall segments 12 and 14, respectively, integrally joined together by a transverse web compositely made up of a centrally disposed and generally C-shaped tubular section or core 16 and a pair of web segments 18 and 20 extending from the perimeter of the tubular core 16 to approximately the midpoint of the walls 12 and 14. The side wall segments 12 and 14 of the column 10 each include a plurality of integral parallel ribs defining a pair of U-shaped channels 22, 22' and 24, 24' running the entire length of the inner sides thereof. As shown, these channels are disposed in spaced relation on either side of the webs 18 and 20 and are preferably located adjacent to the marginal edges of wall segments 12 and 14.

Figure 2:
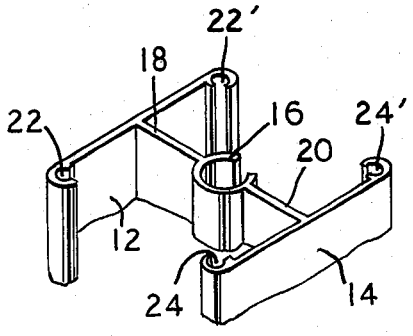
FIG. 2 is an oblique view of a further configuration of a load-bearing column member.

In order to enhance the load-bearing capabilities of the column 10, the marginal edges of side wall segments 12 and 14 desirably include integral inwardly directed flange segments 26, 26' and 28, 28'. In installations wherein relatively light loadings may be encountered, a column of the cross-sectional configuration illustrated in FIG. 2 may be employed. This embodiment is of basically similar configuration to that of FIG. 1 except that the U-shaped channels 22, 22' and 24, 24' are here selectively located at the marginal edges of walls 12 and 14 and constitute compositely functioning inwardly directed flanges of relatively small dimension.

A load-bearing plate member 30, having generally the same rectangular dimensions defined by the cross-section of column 10 and a centrally disposed circular opening therein, is adapted to be disposed into superposed abutting relationship with the upper end of column 10. When so positioned, the circular opening therein will be disposed concentric with and in overlying relation with the C-shaped tubular core 16 of column 10. The plate 30 is readily positioned in secured relation to the upper end of the column 10 by means of downwardly displaced and displaceable punch tabs 32 selectively located therein in such manner that the tabs 32 are adapted to be snugly fitted into abutting relationship with the upper ends of the channels 22, 22' and 24, 24' when a downwardly compressive force is exerted against the top of plate 30. If desired, alternate means may be used for securing the bearing plate 30 in secure superposed relation with the upper end of the column 10 as by means of self-tapping screws insertable through selectively located holes in plate 30 (not shown) and into threaded engagement with the channels 22, 22' and 24, 24'.

Vertical adjustment of the overall effective column length is effected by means of a hexagonally or other selectively contoured headed bolt 34 having a threaded shaft 36 and a nut 38 mounted thereon. The diameter of the threaded shaft 36 is sufficiently less than that of the central hole in bearing plate 30 and that of the C-shaped tubular core 16 in column 10 so as to allow free vertical movement of the shaft when the base portion thereof is disposed therewithin. The underside of the nut 38, when threaded onto the shaft 36, is adapted to be disposed in abutting relationship with the upper surface of bearing plate 30 surrounding the aperture therein. To facilitate the turning of the nut 38, a washer 40 is desirably interposed between the nut and plate. Such washer 40 is preferably cadmium plated or galvanized to reduce the frictional resistance and to minimize wear and grooving of the bearing plate 30.

Secure engagement of the load-bearing structure to be supported, as for example a spanning beam 44 or the like having a planar undersurface, is effected by selectively contoured supporting bracket 42. Such supporting bracket 42, for a conventional beam, includes a generally planar body portion adapted to be disposed in abutting interfacial engagement with the underside of the beam 44, marginally bounded by a pair of upwardly directed flanges 46 adapted to be disposed in embrasive engagement with the lower marginal edges of beam 44. Generally disposed within the planar body portion of the bracket 42 is a complementally sized hexagonally-shaped opening whose defining marginal walls 48 serve to receive and non-rotatably position the hexagonal head of bolt 34 in flush engagement with the underside of beam 44. Desirably, the marginal flanges 46 include suitable holes 50 sized to accommodate self-tapping screws or other fastening devices to selectively secure the bracket 42 in desired positional relation with the beam 44 to be supported. In situations where possible slippage of the column is to be minimized and/or where precision of location of the column is a necessity, the marginal flanges 46 desirably also include slots 52 sized to accommodate positioning lugs or plates that are either integral with or are securable to the beam 44.

In the utilization of the above described unit, elongated lengths of column 10 together with quantities of the other described components are made available at the situs of desired installation. Each column 10 can then be cut to appropriate length for the specific characteristics of the locus of installation. After the column 10 has been cut to the appropriate length, the metal bearing plate 30 is positioned on the upper end of column 10 with the circular opening therein concentric with the C-shaped tube section 16 and is secured in such position either by means of self-tapping screws inserted through apertures in the plate 30 into threaded engagement with the slots 22, 22′, 24, 24′ or by the snap-in arrangement with the tabs 32 as described above.

The nut 38 is then disposed closely adjacent to the head of the bolt 34 and the extending portion of the threaded shaft 36 thereof inserted into the coaligned openings of the bearing plate 30 and tubular core 16 of the column 10 with the washer 40 interposed between the undersurface of the nut 38 and the upper surface of the bearing plate. The supporting bracket 42 is then positioned in embrasive relation with the underside of the beam 44 with the aperture therein located to receive the head of the bolt 34. The column, bearing plate and adjusting assembly, is then vertically positioned to align the head of the bolt with the aperture in the supporting bracket and the nut 38 is rotatably displaced on the threaded shaft 36 to displace the head of the bolt toward and into load supporting relation with the beam 44 with concomitant assumption of at least a portion of the loads borne thereby.

Having thus described my invention as set forth above, I claim:

1. An adjustable load-bearing column assembly for supporting beams and the like comprising an elongated generally H-shaped metal column having a pair of spaced parallel side wall segments integrally joined together over the full length thereof by a transverse web compositely constituted of an intermediate generally C-shaped tubular core and a pair of web segments extending therefrom and joined to the midpoint of said side wall segments, a bearing plate adapted to be secured to overlying abutting relationship with the upper end of said column, said plate having a generally circular opening concentric with and overlying the centrally disposed C-shaped tubular core of said column, a bolt member having a threaded shaft with a selectively contoured head at one end thereof and a nut member in rotatable threaded engagement therewith, the undersurface of said nut being disposed in supportive facing relation with the upper surface of said bearing plate and with the portion of said threaded shaft of said bolt disposed beneath said nut extending through the aperture in said bearing plate and into said C-shaped tubular core of said column, a bracket member disposable in abutting embracive engagement with the undersurface of a beam to be supported having a complementally shaped opening therein sized to non-rotatably receive and contain said head of said bolt to prevent the bolt from being rotatably displaced when said nut is turned to effect vertical displacement thereof.

2. The adjustable load-bearing column assembly as described in claim 1 including integral U-shaped channels in the facing surfaces of said side wall segments, the terminal ends thereof being engageable with said bearing plate to secure the latter to the column end.

3. The adjustable load-bearing column assembly as described in claim 1 wherein said bracket member includes a pair of marginal flanges sized to encompass the marginal edges of said beam to be supported.

4. The adjustable load-bearing column assembly as described in claim 3 wherein said marginal flanges include means to interlock with said beam member to prevent displacement of said bracket member relative thereto.

* * * * *